US006397404B1

(12) United States Patent
Ferreyra et al.

(10) Patent No.: US 6,397,404 B1
(45) Date of Patent: Jun. 4, 2002

(54) TOILET FLUSHING SYSTEM

(76) Inventors: Carlos A. Ferreyra, P.O. Box 304993, St.Thomas, VI (US) 00803; Alejandro L. Ferreyra, San Martin 243, 8303 Cinco Saltos, Rio Negro (AR)

( * ) Notice: Subject to any disclaimer, the term of this patent is extended or adjusted under 35 U.S.C. 154(b) by 0 days.

(21) Appl. No.: 09/728,335

(22) Filed: Dec. 1, 2000

(51) Int. Cl.[7] ..... E03D 1/34
(52) U.S. Cl. ..... 4/390; 4/391
(58) Field of Search ..... 4/390, 391, 395

(56) References Cited

U.S. PATENT DOCUMENTS 386,918 A * 7/1888 Demarest ..... 4/391
3,280,407 A * 10/1966 Aaron ..... 4/391
6,199,221 B1 * 3/2001 Stahlhut ..... 4/391

* cited by examiner

*Primary Examiner*—Michael Powell Buiz
*Assistant Examiner*—Tuan Nguyen
(74) *Attorney, Agent, or Firm*—J. Sanchelina; A. Bordas

(57) ABSTRACT

A toilet flushing system primarily having an actuating assembly, guide housing, funnel assembly and flexible hose. Designed to minimize water utilization, the water inlet is located above the water line in a natural state. With the ability to select the desired amount of water for flushing, the actuating assembly is pushed vertically downward within the guide housing to overcome the upward buoyancy force surrounding the funnel assembly. The flushing cycle may be interrupted by vertically pulling the actuating assembly with sufficient force to overcome the water pressure established over the funnel assembly.

5 Claims, 5 Drawing Sheets

TOILET FLUSHING SYSTEM

II. BACKGROUND OF THE INVENTION

1. Field of the Invention

The present invention relates to discharging liquids from containers, and more particularly, to a toilet flushing mechanism.

2. Description of the Related Art

Conservation of water is a universal concern. Many designs for toilet systems have been designed in the past. The majority of them however, include complex mechanisms interconnected by various links and pivoting hinges, designed to flush water out of toilet tanks. With these complex systems, the prior art has shown inefficiencies by the way of utilization of more water than is necessary to flush matter into a sewage system. Additionally, build up of foreign matter on a tank ball or valve seat contributes to seepage and ultimately wasting of water that otherwise may have been utilized for its intended purpose. Other contributions to water waste include valve deformation, improper valve alignment and deterioration. Water seepage, especially due to valve and hose defects, is common because such parts operate submerged in the tank under constant water pressure from above.

There are no similar toilet flushing mechanisms to the best of applicant's knowledge, that incorporate a funnel system with a flotation device, serving as the water inlet for flushing purposes, which is located above the water line in a natural state.

III. SUMMARY OF THE INVENTION

It is one of the main objects of the present invention to provide a simple and efficient system to flush water from a toilet tank.

It is another object of this invention to provide a toilet flushing system that may be incorporated into existing toilets without major modifications.

It is another object of this invention to provide a toilet flushing system that conserves water by controlling the amount to be flushed.

It is still another object of the present invention to provide a toilet flushing system that minimizes seepage where the water intake for flushing is above the water line at the natural state.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

Figure 4A:
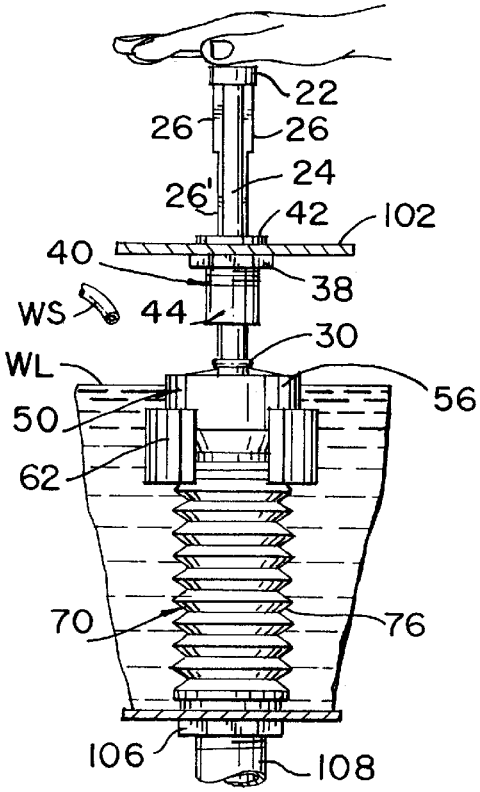

FIG. 4*a* illustrates an elevational view of the present invention at the initial stage before flushing.

Figure 4B:
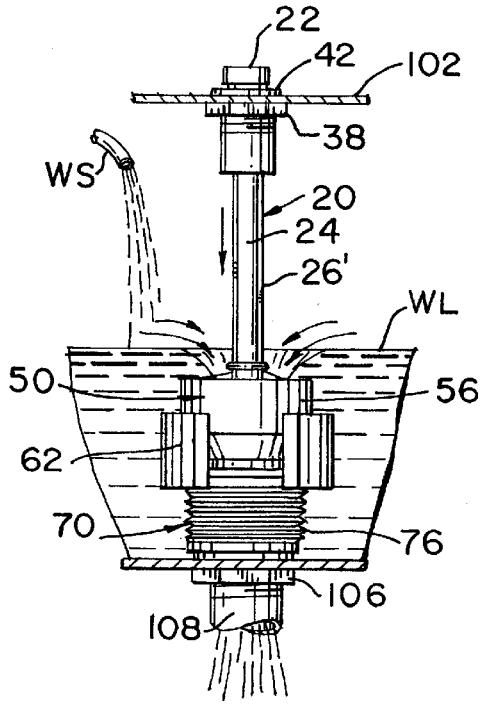

FIG. 4*b* illustrates an elevational view of the present invention while flushing as water enters the funnel assembly.

Figure 4C:
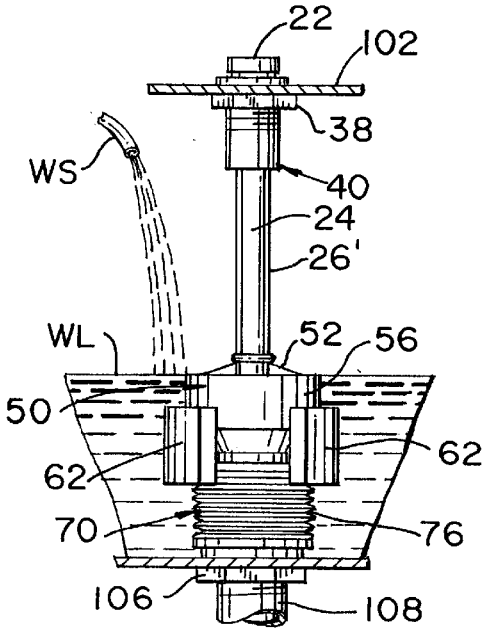

FIG. 4*c* illustrates an elevational view of the present invention at the position after completely flushing, with the flexible hose compressed.

Figure 4D:
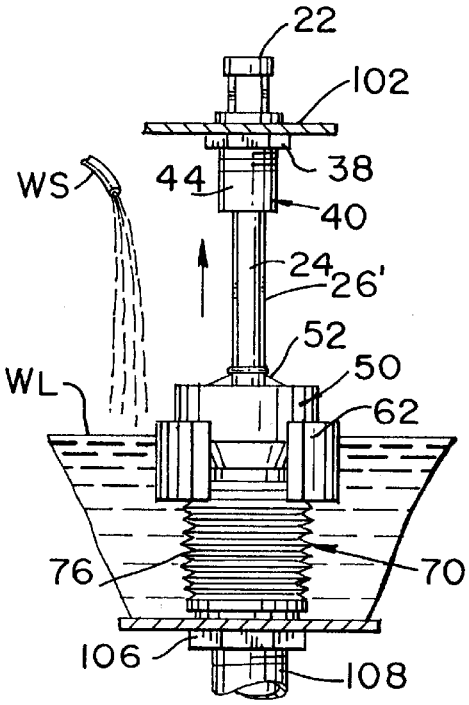

FIG. 4*d* illustrates an elevational view of the present invention after flushing when the buoyancy force from the float has overcome the pressure from the water.

Figure 4E:
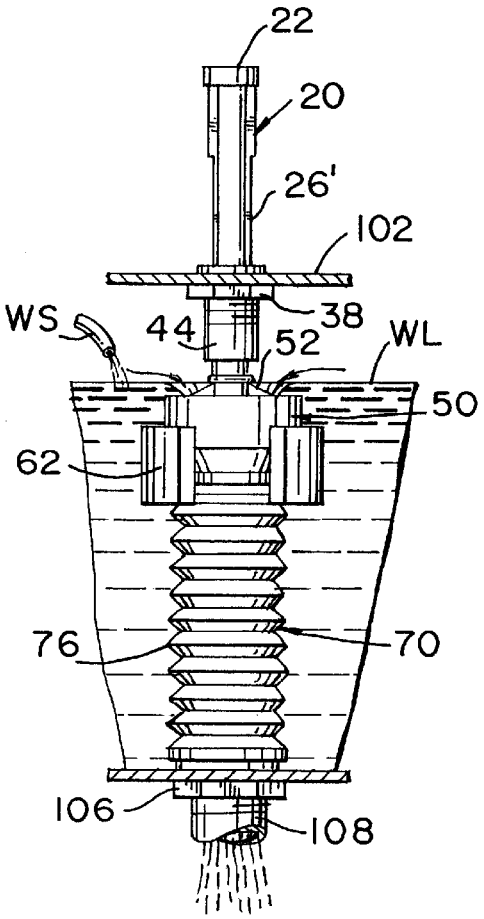

FIG. 4*e* illustrates an elevational view of the present invention when the water source continues to flow after its predetermined amount.

Figures 5, 6:
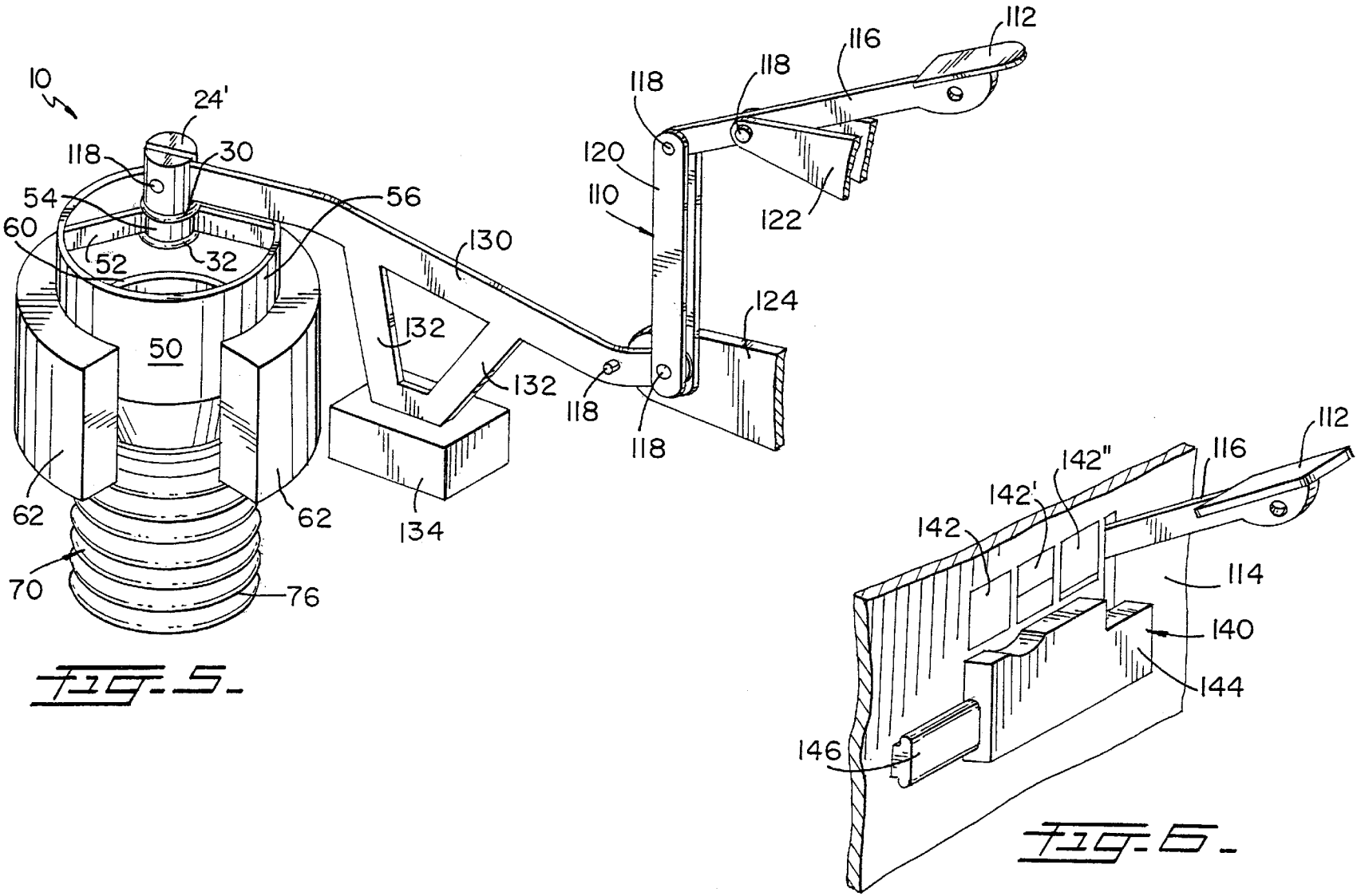

FIG. 5 is a perspective view of the present invention in an alternate embodiment.

FIG. 6 is a perspective view of a flush control gauge in an alternate embodiment.

V. DETAILED DESCRIPTION OF THE PREFERRED EMBODIMENT

Referring now to the drawings, where the present invention is generally referred to with numeral 10, it can be observed that it basically includes actuating assembly 20, guide housing 40, funnel assembly 50, and flexible hose assembly 70.

Figure 1:
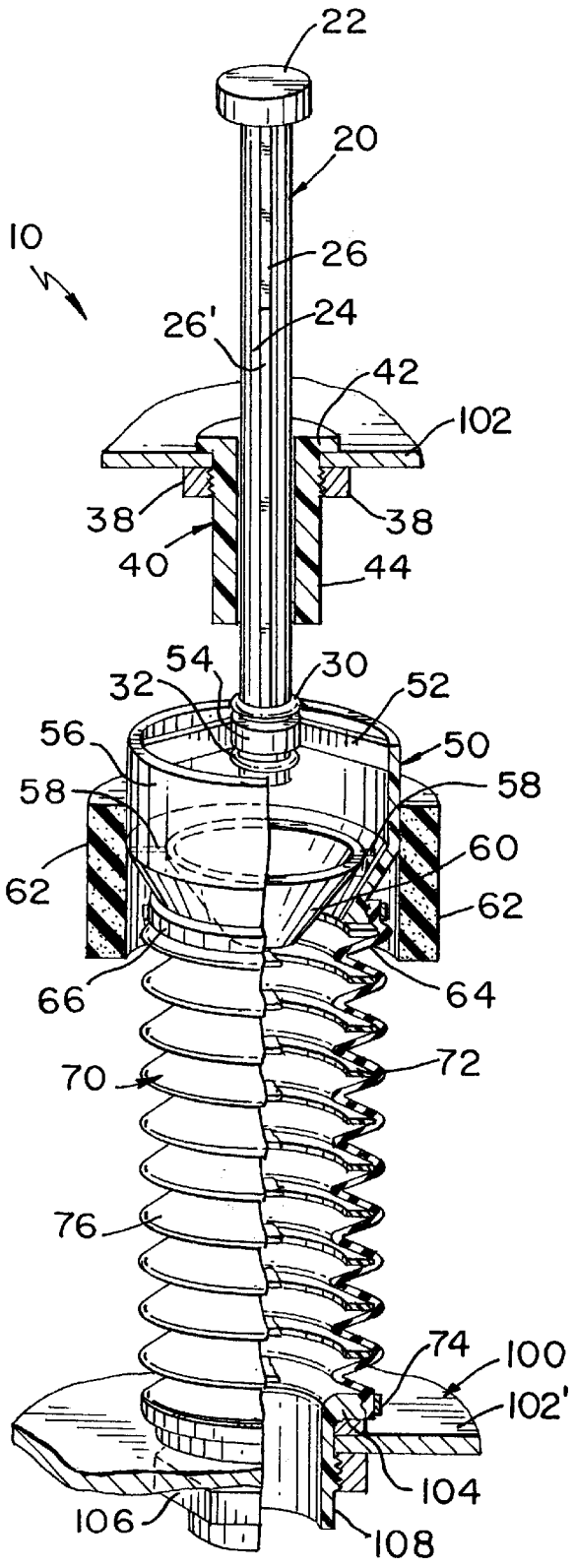
FIG. 1 represents an isometric view of the present invention.

As seen in FIG. 1, actuating assembly 20 has handle 22 fixedly secured at one end of tubular member 24. Handle 22 is manipulated by a user to actuate and control instant invention 10. Tubular member 24 slidably journals within guide housing 40 for stabilization. Guide housing 40 snugly fits a through-hole of toilet lid 102. Flanged lip 42 of guide housing 40 is of sufficient area to keep guide housing 40 from falling within the through-hole of toilet lid 102. Opposite from handle 22 of actuating assembly 20 is bead 30 mounted thereon. Actuating assembly 20 is manufactured from a durable water-proof material such as plastic, or a material of similar characteristics.

Removably secured to actuating assembly 20 is funnel assembly 50. Funnel assembly 50 has exterior funnel 56 and interior funnel 60. Exterior funnel 56 has connectors 52 extending from the inside diameter towards the center. Ring 54 is formed at the center and is of cooperative dimensions to receive tubular member 24. Ring 54 abuts bead 30, and removable retainer 32 secures funnel assembly onto actuating assembly 20. Fastenly secured by connectors 58, interior funnel 60 is located at a predetermined distance from exterior funnel 56. Secured to the exterior surface of exterior funnel 56 is float 62. The inside surface of float 62 is of a cooperative shape to snugly secure to the exterior surface of exterior funnel 56. Exterior funnel 56 further has flanged lip 64. Flanged lip 64 extends from exterior funnel 56 to have flexible hose 76 snugly fit over. Clamp 66 secures flexible hose 76 to funnel assembly 50. Spacer rings 72 snugly fit within ridged sections in order to stabilize and erect flexible hose 76. Additionally, in the preferred embodiment, flexible hose 76 is fastenly secured to base wall 102' of toilet 100, by clamp 74. Toilet 100 has out-take pipe 108. Flanged lip 104 helps secure flexible hose 76. Additionally, retainer 106 keeps out-take pipe 108 stationary.

Figure 2:
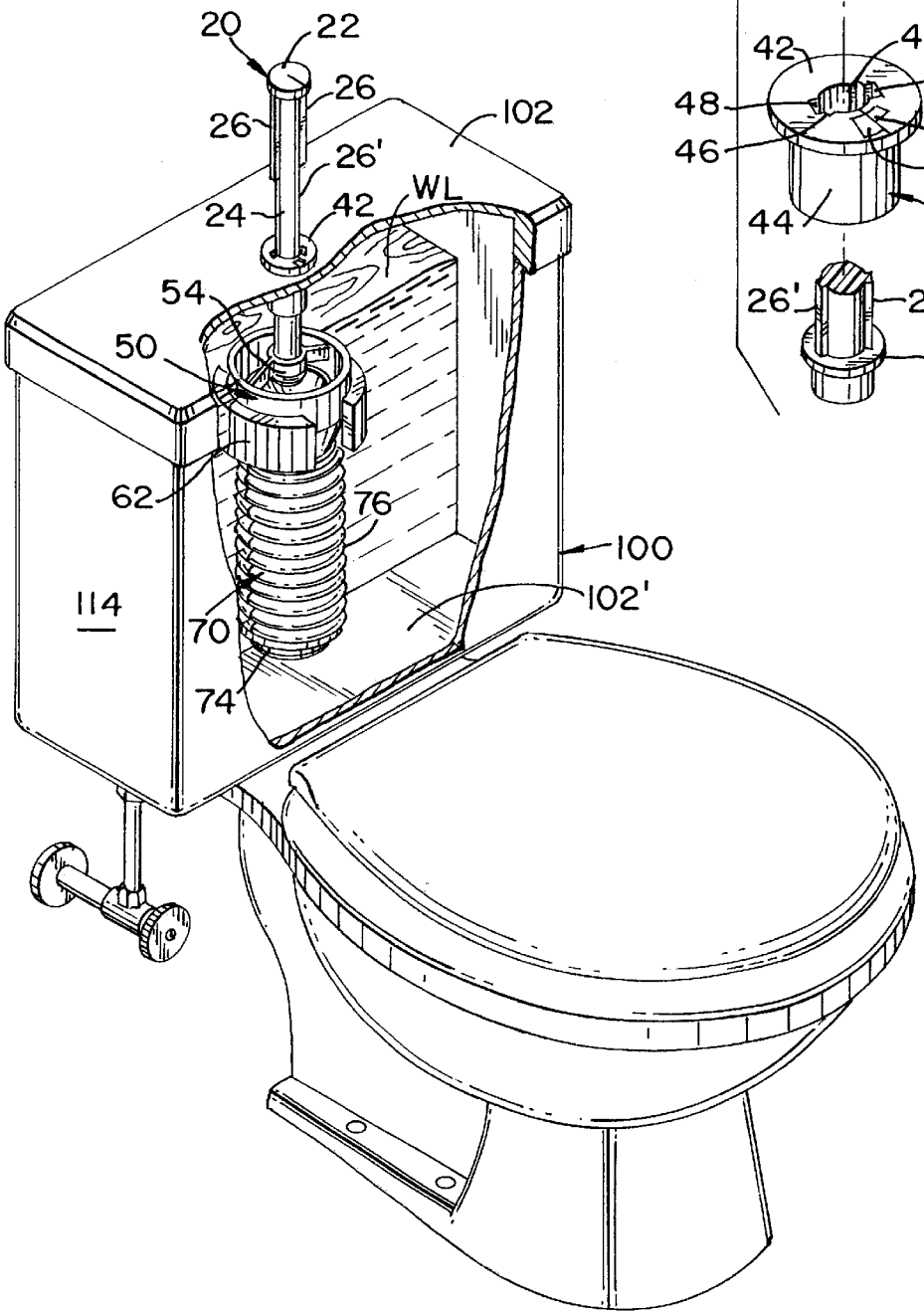
FIG. 2 shows a perspective view of the present invention with a cut-out of a toilet.

As seen in FIG. 2, instant invention 10 may be installed in standard toilets with minor modifications. Toilet lid 102 of toilet 100 has a hole to allow for actuating assembly 20 to trespass therethough. As a flushing system, instant invention 10 is designed to rid water from any container, or tank 114 in the preferred embodiment. Toilet 100, as a standard toilet, has an independent water source WS, seen in FIG. 4a and valve system, not shown, to control water level WL.

Figure 3:
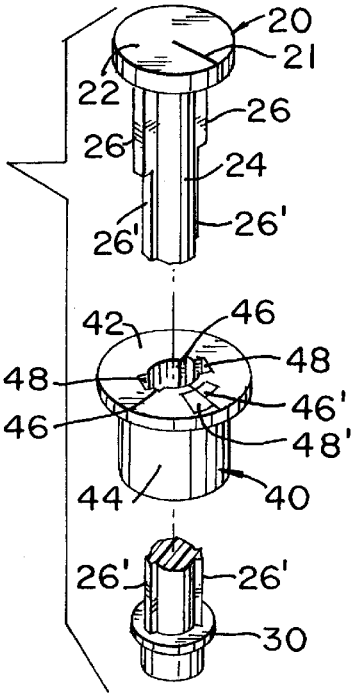
FIG. 3 illustrates an exploded view of the actuating assembly and guide housing.

Seen in FIG. 3 is actuating assembly 20 and guide housing 40. Guide housing 40 has flanged lip 42 mounted perpendicularly over cylindrical member 44. Marked on flanged lip 42 are flush guides 46' and 48'. Flush guide 46' represents an approximate half tank water flush whereas flush guide 48' represents a full tank water flush. To control the desired flush, the user rotates handle 22, so that indicator 21 points generally towards flush guide 46' or 48'. Mounted on tubular member 24 are vertical strip members 26, which have steps 26'. Vertical strip members 26, and their respective steps 26' have cooperative dimensions with grooves 46 and 48. For an approximate half tank flush, indicator 21 generally points towards flush guide 46', and vertical strip members 26 and steps 26' align with grooves 46. In this position, steps 26' have cooperative dimensions to slidably journal within grooves 46, however, vertical strip members 26 do not. Thus only approximately half of tubular member 24 travels vertically downward, creating an approximated half flush. For a full tank flush, indicator 21 generally points towards flush guide 48', and vertical strip members 26 with steps 26' align with grooves 48 and slidably journal within guide housing 40. Once a desired flush is selected, the user pushes handle 22 vertically downward to initiate the flushing system.

As seen in FIG. 4*a,* instant invention 10 is in a stationary position, before the flushing cycle has begun. Water level WL is at the maximum level as controlled by the shut off valve of the toilet, not seen. At this position, flexible hose 76 is extended due to the buoyancy of float 62 attached to funnel assembly 50. At this position, water level WL is below the top rim of funnel assembly 50 so as to prevent water from escaping. Additionally, retainer 38 keeps guide housing 40 stationary upon toilet lid 102.

As seen in FIG. 4*b,* the flushing cycle has begun. The user has pushed handle 22 vertically downward with sufficient force to overcome the upward buoyancy force of float 62. With the vertically downward force from the user, the top rim of funnel assembly 50 plunges downward and below water level WL. At this moment, due to the water pressure contained within tank 114, seen in FIG. 2, water immediately enters exterior funnel 56, interior funnel 60, seen in FIG. 1, and the space established between them. Water travels through funnel assembly 50, flexible hose 76, and finally exiting through out-take pipe 108. While flushing, the water pressure established over the top rim of funnel assembly 50 causes flexible hose 76 to vertically collapse as water flows through. During the initial stage of the flushing cycle, as depicted in this figure, the user may interrupt the flush simply by pulling handle 22 of actuating assembly 20 vertically upward with sufficient force to overcome the water pressure in tank 114, seen in FIG. 2, escaping through funnel assembly 50.

As seen in FIG. 4*c,* all the available water in tank 114, seen in FIG. 2, for flushing has escape through funnel assembly 50 and flexible hose 76 is still compressed.

As seen in FIG. 4*d,* the upward buoyancy force of float 62 has overcome the water pressure force within tank 114, seen in FIG. 2. At this position, the water replenishment stage begins from toilet water source WS for a subsequent flush. Upward buoyancy force of float 62 keeps funnel assembly 50 above water level WL. As water enters tank 114, seen in FIG. 2, from water source WS, flexible hose 76 expands until reattaining the position shown in FIG. 4*a,* thus completing the flushing cycle.

In the event that independent water supply WS or a valve mechanism, not seen, malfunctions, water may continue to enter tank 114, seen in FIG. 2. Seen in FIG. 4*e,* flexible hose 76 is fully extended due to the upward buoyancy force of float 62. Water eventually reaches the top rim of funnel assembly 50 and escapes through. However, so long as funnel assembly 50 is not plunged into tank 114, seen in FIG. 2, water will only seep into funnel assembly 50 and will not activate actuating assembly 20.

Shown in FIG. 5 is an alternate embodiment of instant invention 10. Actuating assembly 110 primarily has lever 116, links 120, and arm 130. Lever 116 has handle 112 fixedly secured. Similarly to handle 22, handle 112 is manipulated by a user to actuate and control instant invention 10. Lever 116 is removably secured to links 120 and stationary links 122 with pins 118. Arm 130 connects to tubular member 24', links 120, and stationary link 124 with pins 118. Stationary links 122 and 124 are fastenly secured to an inside wall of tank 114, seen in FIG. 2. At a predetermined angle, arm 130 has connectors 132 extending therefrom. Connectors 132 secure float 134. Funnel assembly 50 has exterior funnel 56 and interior funnel 60. Exterior funnel 56 has connectors 52 extending from the inside diameter towards the center. Ring 54 is formed at the center and is of cooperative dimensions to receive tubular member 24'. Ring 54 abuts bead 30, and removable retainer 32 secures funnel assembly onto tubular member 24'. Secured to the exterior surface of exterior funnel 56 is float 62. The inside surface of float 62 is of a cooperative shape to snugly secure to the exterior surface of exterior funnel 56.

To operate instant invention 10 in this alternate embodiment, the user actuates handle 112, thereby engaging links 120, arm 130, and ultimately funnel assembly 50. As in the preferred embodiment, with manipulation of handle 112, the flush may be interrupted.

Seen in FIG. 6 is a flush guide 140 in an alternate embodiment. Flush guide 140, when installed to complement the alternate embodiment shown in FIG. 5, is utilized to determine the amount of water to be used for flushing. Slide member 144 generally travels in a horizontal direction, riding upon track 146 which is securely fastened to an exterior wall of tank 114. Indicators 142, 142', and 142" serve as visual representations of the flush amount selection that corresponds to the surface upon slide member 144. After making the desired selection for flushing, handle 112 is pushed in the direction of slide member 144 until making contact with the corresponding surface, thus determining the amount of water to flush.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A flushing mechanism for a container assembly, comprising.

A) an actuating assembly having a shaft with first and second ends, said first end having a handle and said second end including retaining means, said actuating assembly further includes an annular bead on said shaft at a first predetermined distance from said first end towards said second end without reaching said second end, and a guide housing receiving said shaft therethrough;

B) a funnel assembly with third and fourth ends, said funnel assembly having at least one exterior and one interior funnels whereas said third end secures against said annular bead and is held by said retaining means on said second end, and said fourth end includes a flange rigidly mounted thereon, said exterior funnel having a tubular vertical wall above said interior funnel includes a float axially mounted thereon, causing said funnel assembly to remain buoyant;

C) a flexible hose assembly with fifth and sixth ends, said fifth end having cooperative dimensions to secure to said fourth end and said sixth end having cooperative dimensions to secure to an out-take pipe of said container; and D) wherein a user exerting a downwardly force on said actuating assembly to overcome the generally upward buoyancy force of said float and to flush fluid through said funnel assembly, wherein said actuating assembly may be interrupted by a user when desired.

2. The flushing mechanism for a container assembly set forth in claim 1, wherein said shaft has vertical strips mounted thereon.

3. The flushing mechanism for a container assembly set forth in claim 2, wherein said guide housing has first and second grooves.

4. The flushing mechanism for a container assembly set forth in claim 3, wherein said handle has adjustment means to establish the amount of fluid to be utilized whereas said adjustment means includes:

E) said vertical strips selectively brought in alignment with said first groove thereby restricting the travel of said shaft and in alignment with said second groove having unobstructed travel that permits the full flush operation of said container.

5. The flushing mechanism for a container assembly set forth in claim 4, wherein said container is a toilet tank.

* * * * *